US012781409B2

(12) United States Patent
Chung et al.

(10) Patent No.: US 12,781,409 B2
(45) Date of Patent: Nov. 3, 2026

(54) APPLIANCES CONTACTLESS REMOTE ACTIVATION

(71) Applicant: Haier US Appliance Solutions, Inc., Wilmington, DE (US)

(72) Inventors: MyungGeon Chung, Seoul (KR); Minji Jeong, Suwon (KR)

(73) Assignee: Haier US Appliance Solutions, Inc., Wilmington, DE (US)

( * ) Notice: Subject to any disclaimer, the term of this patent is extended or adjusted under 35 U.S.C. 154(b) by 183 days.

(21) Appl. No.: 18/800,600

(22) Filed: Aug. 12, 2024

(65) Prior Publication Data

US 2026/0043184 A1 Feb. 12, 2026

(51) Int. Cl.
*D06F 34/05* (2020.01)
*D06F 101/00* (2020.01)

(52) U.S. Cl.
CPC ..... *D06F 34/05* (2020.02); *D06F 2101/00* (2020.02)

(58) Field of Classification Search
CPC ..... D06F 34/05; D06F 2101/00
See application file for complete search history.

(56) References Cited

U.S. PATENT DOCUMENTS 11,018,888 B2 * 5/2021 Gary, Jr. ..... H04L 12/282
11,098,430 B2 8/2021 Belveal et al.
2009/0320538 A1 * 12/2009 Pellaton ..... G07C 9/00698 70/278.1
2013/0205370 A1 * 8/2013 Kalgi ..... G06F 21/316 726/3
2015/0026753 A1 * 1/2015 Abbruzzese ... H04N 21/440218 725/133
2015/0251875 A1 * 9/2015 Lustenberger ..... B66B 5/0031 700/275
2015/0373304 A1 * 12/2015 Menand ..... H04N 21/25816 725/10
2017/0082991 A1 * 3/2017 Belveal ..... D06F 39/00
2017/0289120 A1 10/2017 Kohli et al.
2018/0173175 A1 * 6/2018 Zhang ..... G06Q 10/02
2020/0012244 A1 1/2020 Belveal et al.
2020/0257788 A1 * 8/2020 Bhattacharyya ..... G06F 21/31
2021/0076106 A1 * 3/2021 Marten ..... G06F 40/279
2023/0305680 A1 * 9/2023 Liu ..... H04L 12/281
2024/0027982 A1 * 1/2024 Hu ..... G06V 10/82
2024/0141576 A1 5/2024 Chung et al.

* cited by examiner

*Primary Examiner* — Santosh R Poudel
(74) *Attorney, Agent, or Firm* — Dority & Manning, P.A.

(57) ABSTRACT

A method of operating an appliance includes transmitting, by a remote computing device, a first portion of an access code to the appliance and a second portion of the access code to a remote user interface device. The method also includes displaying the first portion of the access code on a display of the appliance and displaying at least part of the second portion of the access code on a display of the remote user interface device. The method further includes receiving a verification input at the remote user interface device. The verification input is based on the access code. The method also includes activating the appliance in response to the verification input received at the remote user interface device. Activating the appliance comprises initiating an operation cycle of the appliance.

18 Claims, 8 Drawing Sheets

APPLIANCES CONTACTLESS REMOTE ACTIVATION

FIELD

The present subject matter relates generally to appliances, such as laundry appliances or cooking appliances, and more specifically, to systems and methods to facilitate remote activation of such appliances.

BACKGROUND

Appliances are utilized generally for a variety of tasks by a variety of users. For example, a household or commercial setting may include such appliances as laundry appliances, e.g., a washing machine appliance and/or dryer appliance, kitchen appliances, e.g., an oven appliance, a dishwasher appliance, etc., along with other various appliances.

Typical appliances do not currently include fully remote activation and operation thereof for reasons such as safety and security. For example, some appliances may include features which generate high levels of heat, e.g., heating elements of a cooking appliance or a heat system of a dryer appliance, and/or may include enclosable internal volumes, such as inside of a drum of a dryer appliance, a wash basket of a washing machine appliance, or a food storage compartment in a refrigerator or freezer appliance. Accordingly, many appliances include features for verifying a user is physically present at the appliance, and such features require physical contact with the appliance by the user.

Laundry appliances, such as washing machine appliances and dryer appliances, are commonly used to wash and dry, respectively, a load of clothes. Specifically, washing machine appliances generally include a wash tub for containing water or wash fluid and a wash basket rotatably mounted within the wash tub for receiving the load of clothes. These washing machines are typically equipped to operate in one or more modes or cycles, such as wash, rinse, and spin cycles. After the washing machine processes are complete, the load of clothes is moved over the to the dryer, which includes a cabinet with a drum rotatably mounted therein and a heating assembly that supplies heated air into a chamber of the drum, e.g., through a duct mounted to a back wall of the drum, to facilitate a drying process.

Users can operate an oven appliance to cook food items as desired by selecting or manipulating various operational features of the oven appliance, such as e.g., the temperature setting or mode of operation (i.e., bake, broil, etc.). In some instances, users may desire to select or manipulate these operational features remotely or "hands free." Some oven appliances may include a "remote enable" mode that allows users to remotely modify operational features of the oven appliance. Some features, however, may require that a user be in attendance or in the presence of the oven appliance when operating the oven appliance, which is referred to herein as "attended operation." Examples of features that may require attended operation can include turning on the oven appliance, selecting a temperature setting, or choosing a mode of operation of the oven appliance. Among other safety reasons, requiring attended operation ensures that a user has had an opportunity to check for non-food items placed within the cooking chamber of the oven appliance or on the cooktop of the oven appliance before it is turned on.

In some cases, such as in a laundromat or other commercial setting in which multiple users touch the same appliance, a user may desire fully contactless operation of the appliance, such as to avoid germs or contamination from touching the high-use appliance.

Accordingly, appliances with features for improved safety and performance would be desirable. More specifically, systems and methods for activating and/or operating the appliance remotely while verifying attendance at the appliance without requiring direct physical contact with the appliance would be particularly beneficial.

BRIEF DESCRIPTION OF THE INVENTION

Aspects and advantages of the invention will be set forth in part in the following description, or may be apparent from the description, or may be learned through practice of the invention.

In one exemplary embodiment, a method of operating an appliance is provided. The method includes initiating a session with the appliance from a remote user interface device and receiving a control input for the appliance at the remote user interface device. The method also includes transmitting a first portion of an access code to the appliance from a remote computing device in response to the control input and transmitting a second portion of the access code to the remote user interface device from the remote computing device in response to the control input. The method further includes displaying the first portion of the access code on a display of the appliance and displaying at least part of the second portion of the access code on a display of the remote user interface device. The method also includes receiving a verification input at the remote user interface device. The verification input is based on the access code. The method further includes activating the appliance in response to the verification input received at the remote user interface device. Activating the appliance includes initiating an operation cycle of the appliance according to the control input.

In another exemplary embodiment, a method of operating an appliance is provided. The method includes receiving a start request for the appliance from a remote user interface device. The method also includes transmitting, by a remote computing device in response to the start request, a first portion of an access code to the appliance and a second portion of the access code to the remote user interface device. The method further includes displaying the first portion of the access code on a display of the appliance and displaying at least part of the second portion of the access code on a display of the remote user interface device. The method also includes receiving a verification input at the remote user interface device. The verification input is based on the access code. The method further includes activating the appliance in response to the verification input received at the remote user interface device. Activating the appliance includes initiating an operation cycle of the appliance.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
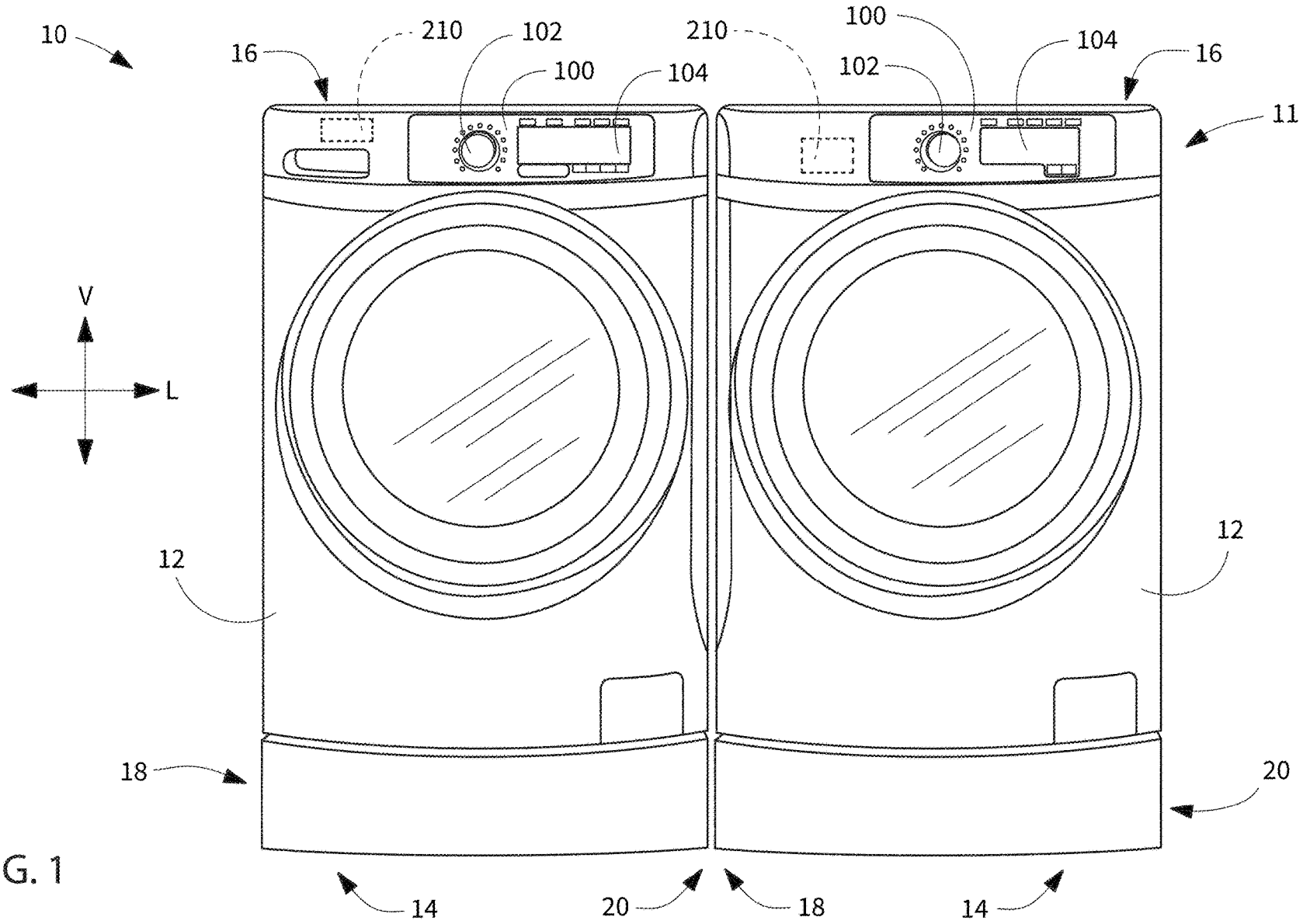
FIG. 1 provides a front view of exemplary appliances, e.g., an exemplary washing machine appliance and an exemplary dryer appliance, in accordance with one or more exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "includes" and "including" are intended to be inclusive in a manner similar to the term "comprising." Similarly, the term "or" is generally intended to be inclusive (i.e., "A or B" is intended to mean "A or B or both"). Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a 10 percent margin.

Directional terms such as "left" and "right" are used herein with reference to the perspective of a user standing in front of an appliance to access the appliance and/or items therein. Terms such as "inner" and "outer" refer to relative directions with respect to the interior and exterior of the appliance. For example, "inner" or "inward" refers to the direction towards the interior of the appliance. Terms such as "left," "right," "front," "back," "top," or "bottom" are used with reference to the perspective of a user accessing the appliance. For example, a user stands in front of the appliance to open the door(s) and reaches into the appliance to add, move, or withdraw items therein.

As used herein, the terms "first," "second," and "third" may be used interchangeably to distinguish one component from another and are not intended to signify location or importance of the individual components. As used herein, terms of approximation, such as "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counterclockwise.

Exemplary appliances are illustrated in FIGS. 1 through 5, e.g., the appliance may, in various example embodiments, be a laundry appliance such as a washing machine appliance or a dryer appliance, or a cooking appliance such as a range or cooktop, or other appliance. According to various embodiments of the present disclosure, the "appliance" may take the form of any of the example appliances described herein, or may be any other appliance. Thus, it will be understood that the present subject matter is not limited to any particular appliance.

Figure 2:
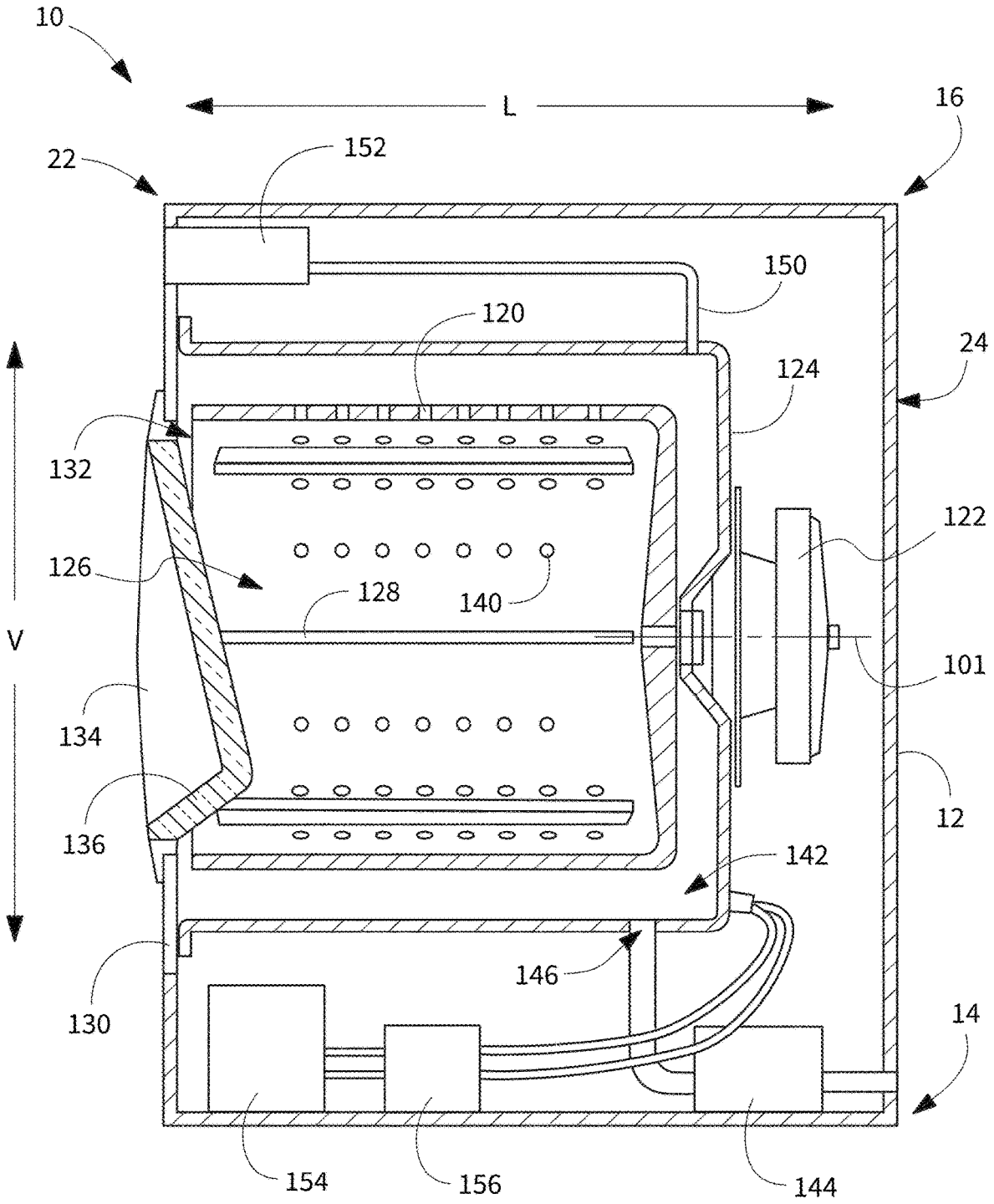
FIG. 2 provides a transverse cross-sectional view of the exemplary washing machine appliance of FIG. 1.
Figure 3:
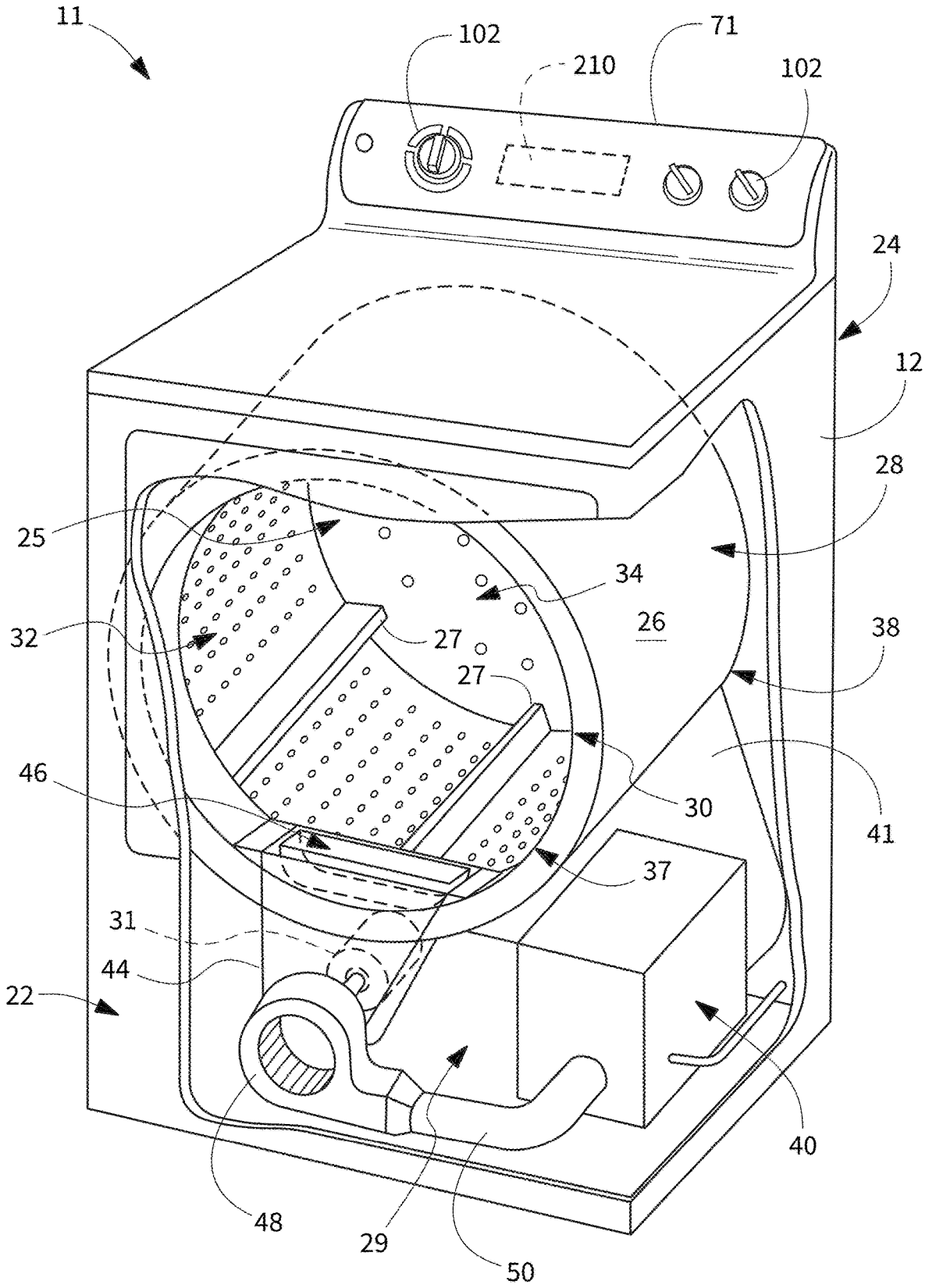
FIG. 3 provides a perspective view of the exemplary dryer appliance of FIG. 1 with portions of a cabinet of the dryer appliance removed to reveal certain components of the dryer appliance.

It should be understood that "household appliance" and/or "appliance" are used herein to describe appliances typically used or intended for common domestic tasks, such as a laundry appliance, e.g., as illustrated in FIGS. 1 through 3, or a cooking appliance (see, e.g., FIGS. 4 and 5) appliance, a dishwashing appliance, a refrigerator, a water heater, etc., and any other appliance which performs similar functions in addition to network communication and data processing. Thus, devices such as a personal computer, router, and other similar devices whose primary functions are network communication and/or data processing are not considered "appliances" as used herein.

As may be seen generally throughout FIGS. 1, 2, 3, 4, and 5, a user interface panel 100 and a user input device 102 may be positioned on an exterior of the appliance. The user input device 102 is generally positioned proximate to the user interface panel 100, and in some embodiments, the user input device 102 may be positioned on the user interface panel 100.

In various embodiments, the user interface panel 100 may represent a general purpose I/O ("GPIO") device or functional block. In some embodiments, the user interface panel 100 may include or be in operative communication with user input device 102, such as one or more of a variety of digital, analog, electrical, mechanical or electro-mechanical input devices including rotary dials, control knobs, push buttons, and touch pads. The user interface panel 100 may include a display component 104, such as a digital or analog display device designed to provide operational feedback to a user. The display component 104 may also be a touchscreen capable of receiving a user input, such that the display component 104 may also be a user input device in addition to or instead of the user input device 102.

User interface panel 100, including user input device 102 and display 104 thereon, provides a local user interface, e.g., a means for users to communicate with and operate the appliance. Thus, user interface panel 100 and the local user interface provide a means for users to communicate with and operate the appliance. It will be appreciated that other components or devices that provide for communication with the appliance for operating the appliance may also be included in the user interface. For example, the user interface may include a speaker, a microphone, a camera (still or video) or motion detection camera for detecting a user's proximity to the appliance or for picking up certain motions, and/or other user interface elements in various combinations.

Generally, each appliance may include a controller 210 in operative communication with the user input device 102. As used herein, "processing device" or "controller" may refer to one or more microprocessors, microcontroller, ASICS, or semiconductor devices and is not restricted necessarily to a single element. The controller 210 may be programmed to operate the appliance by executing instructions stored in memory (e.g., non-transitory media). The user interface panel 100 and the user input device 102 may be in communication with the controller 210 via, for example, one or more signal lines or shared communication busses. Input/output ("I/O") signals may be routed between controller 210 and various operational components of the appliance. Operation of the appliance can be regulated by the controller 210 that is operatively coupled to the user interface panel 100. A user interface panel 100 may for example provide selections for user manipulation of the operation of an appliance, e.g., via user input device 102 and/or display 104. In response to user manipulation of the user interface panel 100 and/or user input device 102, the controller 210 may operate various components of the appliance. Controller 210 may include a memory and one or more microprocessors, CPUs or the like, such as general or special purpose microprocessors operable to execute programming instructions or micro-control code associated with operation of the appliance. The memory may represent one or more memory elements, e.g., random access memory such as DRAM, or read only memory such as ROM or FLASH, or electrically erasable, programmable read only memory (EEPROM). In one embodiment, the processor executes programming instructions stored in memory. The memory may be a separate component from the processor or may be included onboard within the processor. Alternatively, a controller 210 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

The controller 210 may be programmed to operate the appliance by executing instructions stored in memory. For example, the instructions may be software or any set of instructions that when executed by the processing device, cause the processing device to perform operations. Controller 210 can include one or more processor(s) and associated memory device(s) configured to perform a variety of computer-implemented functions and/or instructions (e.g., performing the methods, steps, calculations and the like and storing relevant data as disclosed herein). Controller 210 may include a network interface such that controller 210 can connect to and communicate over one or more networks with one or more network nodes. Controller 210 can also include one or more transmitting, receiving, and/or transceiving components for transmitting/receiving communications with other devices communicatively coupled with the appliance. Additionally or alternatively, one or more transmitting, receiving, and/or transceiving components can be located off board controller 210. It should be noted that controllers 210 as disclosed herein are capable of and may be operable to perform any methods and associated method steps as disclosed herein. For example, in some embodiments, methods disclosed herein may be embodied in programming instructions stored in the memory and executed by the controller 210.

As generally seen throughout FIGS. 1 through 3, in at least some embodiments, each laundry appliance 10 and 11 includes a cabinet 12 which defines a vertical direction V and a lateral direction L that are mutually perpendicular. Each cabinet 12 extends between a top side 16 and a bottom side 14 along the vertical direction V. Each cabinet 12 also extends between a left side 18 and a right side 20, e.g., along the lateral direction L.

Additional exemplary details of the laundry appliances are illustrated in FIGS. 2 and 3. For example, FIG. 2 provides a cross-sectional view of the exemplary washing machine appliance 10. As illustrated in FIG. 2, a wash tub 124 is non-rotatably mounted within cabinet 12. As may be seen in FIG. 2, the wash tub 124 defines a central axis 101. In the example embodiment illustrated by FIG. 2, the central axis 101 may be oriented generally along or parallel to the transverse direction T of the washing machine appliance 10. Accordingly, the washing machine appliance 10 may be referred to as a horizontal axis washing machine.

Referring again to FIG. 2, a wash basket 120 is rotatably mounted within the tub 124 such that the wash basket 120 is rotatable about an axis of rotation, which generally coincides with central axis 101 of the tub 124. A motor 122, e.g., such as a pancake motor, is in mechanical communication with wash basket 120 to selectively rotate wash basket 120 (e.g., during an agitation or a rinse cycle of washing machine appliance 10). Wash basket 120 defines a wash chamber 126 that is configured for receipt of articles for washing. The wash tub 124 holds wash and rinse fluids for agitation in wash basket 120 within wash tub 124. As used herein, "wash fluid" may refer to water, detergent, fabric softener, bleach, or any other suitable wash additive or combination thereof. The wash basket 120 and the tub 124 may collectively define at least a portion of a tub assembly for the washing machine appliance 10.

Wash basket 120 may define one or more agitator features that extend into wash chamber 126 to assist in agitation and cleaning of articles disposed within wash chamber 126 during operation of washing machine appliance 10. For example, as illustrated in FIG. 2, a plurality of ribs 128 extends from basket 120 into wash chamber 126. In this manner, for example, ribs 128 may lift articles disposed in wash basket 120 during rotation of wash basket 120.

Referring generally to FIGS. 1 and 2, cabinet 12 also includes a front panel 130 which defines an opening 132 that permits user access to wash basket 120 within wash tub 124. More specifically, washing machine appliance 10 includes a door 134 that is positioned in front of opening 132 and is rotatably mounted to front panel 130. Door 134 is rotatable such that door 134 permits selective access to opening 132 by rotating between an open position (not shown) facilitating access to a wash tub 124 and a closed position (FIG. 1) prohibiting access to wash tub 124.

A window 136 in door 134 permits viewing of wash basket 120 when door 134 is in the closed position, e.g., during operation of washing machine appliance 10. Door 134 also includes a handle (not shown) that, e.g., a user may pull when opening and closing door 134. Further, although door 134 is illustrated as mounted to front panel 130, it should be appreciated that door 134 may be mounted to another side of cabinet 12 or any other suitable support according to alternative embodiments.

Referring again to FIG. 2, wash basket 120 also defines a plurality of perforations 140 in order to facilitate fluid communication between an interior of basket 120 and wash tub 124. A sump 142 is defined by wash tub 124 at a bottom of wash tub 124 along the vertical direction V. Thus, sump 142 is configured for receipt of and generally collects wash fluid during operation of washing machine appliance 10. For example, during operation of washing machine appliance 10, wash fluid may be urged by gravity from basket 120 to sump 142 through plurality of perforations 140. A pump assembly 144 is located beneath tub 124 for gravity assisted flow when draining tub 124, e.g., via a drain 146. Pump assembly 144 may be configured for recirculating wash fluid within wash tub 124.

A spout 150 is configured for directing a flow of fluid into wash tub 124. For example, spout 150 may be in fluid communication with a water supply (not shown) in order to direct fluid (e.g., clean water) into wash tub 124. Spout 150 may also be in fluid communication with the sump 142. For example, pump assembly 144 may direct wash fluid disposed in sump 142 to spout 150 in order to circulate wash fluid in wash tub 124.

As illustrated in FIG. 2, a detergent drawer 152 is slidably mounted within front panel 130. Detergent drawer 152 receives a wash additive (e.g., detergent, fabric softener, bleach, or any other suitable liquid or powder) and directs the fluid additive to wash chamber 124 during operation of washing machine appliance 10. According to the illustrated embodiment, detergent drawer 152 may also be fluidly coupled to spout 150 to facilitate the complete and accurate dispensing of wash additive.

Additionally, a bulk reservoir 154 is disposed within cabinet 12. Bulk reservoir 154 is also configured for receipt of fluid additive for use during operation of washing machine appliance 10. Bulk reservoir 154 is sized such that a volume of fluid additive sufficient for a plurality or multitude of wash cycles of washing machine appliance 10 (e.g., five, ten, twenty, fifty, or any other suitable number of wash cycles) may fill bulk reservoir 154. Thus, for example, a user can fill bulk reservoir 154 with fluid additive and operate washing machine appliance 10 for a plurality of wash cycles without refilling bulk reservoir 154 with fluid additive. A reservoir pump 156 is configured for selective delivery of the fluid additive from bulk reservoir 154 to wash tub 124.

During operation of washing machine appliance 10, e.g., during a wash cycle of the washing machine appliance 10, laundry items are loaded into wash basket 120 through opening 132, and washing operation is initiated through operator manipulation of input selectors 102. Wash tub 124 is filled with water, detergent, and/or other fluid additives, e.g., via spout 150 and/or detergent drawer 152. One or more valves (not shown) can be controlled by washing machine appliance 10 to provide for filling wash basket 120 to the appropriate level for the amount of articles being washed and/or rinsed. By way of example for a wash mode, once wash basket 120 is properly filled with fluid, the contents of wash basket 120 can be agitated (e.g., with ribs 128) for washing of laundry items in wash basket 120.

After the agitation phase of the wash cycle is completed, wash tub 124 can be drained. Laundry articles can then be rinsed by again adding fluid to wash tub 124, depending on the particulars of the cleaning cycle selected by a user. Ribs 128 may again provide agitation within wash basket 120. One or more spin cycles may also be used. In particular, a spin cycle may be applied after the wash cycle and/or after the rinse cycle in order to wring wash fluid from the articles being washed. During a spin cycle, basket 120 is rotated at relatively high speeds. After articles disposed in wash basket 120 are cleaned and/or washed, the user can remove the articles from wash basket 120, e.g., by opening door 134 and reaching into wash basket 120 through opening 132.

While described in the context of a specific embodiment of horizontal axis washing machine appliance 10, using the teachings disclosed herein it will be understood that horizontal axis washing machine appliance 10 is provided by way of example only. It should be appreciated that the present subject matter is not limited to any particular style, model, or configuration of washing machine appliance. Other washing machine appliances having different configurations, different appearances, and/or different features may also be utilized with the present subject matter as well, e.g., vertical axis washing machine appliances.

FIG. 3 provides a perspective view of the dryer appliance 11 of FIG. 1, which is an example embodiment of an appliance, with a portion of a cabinet or housing 12 of dryer appliance 11 removed in order to show certain components of dryer appliance 11. Dryer appliance 11 generally defines a vertical direction V, a lateral direction L, and a transverse direction T, each of which is mutually perpendicular, such that an orthogonal coordinate system is defined. While described in the context of a specific embodiment of dryer appliance 11, using the teachings disclosed herein, it will be understood that dryer appliance 11 is provided by way of example only. Other dryer appliances having different appearances and different features may also be utilized with the present subject matter as well.

Cabinet 12 includes a front side 22 and a rear side 24 spaced apart from each other along the transverse direction T. Within cabinet 12, an interior volume 29 is defined. A drum or container 26 is mounted for rotation about a substantially horizontal axis within the interior volume 29. Drum 26 defines a chamber 25 for receipt of articles of clothing for tumbling and/or drying. Drum 26 extends between a front portion 37 and a back portion 38. Drum 26 also includes a back or rear wall 34, e.g., at back portion 38 of drum 26. A supply duct 41 may be mounted to rear wall 34 and receives heated air that has been heated by a heating assembly or system 40.

As used herein, the terms "clothing" or "articles" include but need not be limited to fabrics, textiles, garments, linens, papers, or other items from which the extraction of moisture is desirable. Furthermore, the term "load" or "laundry load" refers to the combination of clothing that may be washed together in a washing machine appliance 10 or dried together in a dryer appliance 11 (e.g., clothes dryer) and may include a mixture of different or similar articles of clothing of different or similar types and kinds of fabrics, textiles, garments and linens within a particular laundering process.

A motor 31 is provided in some embodiments to rotate drum 26 about the horizontal axis, e.g., via a pulley and a belt (not pictured). Drum 26 is generally cylindrical in shape, having an outer cylindrical wall 28 and a front flange or wall 30 that defines an opening 32 of drum 26, e.g., at front portion 37 of drum 26, for loading and unloading of articles into and out of chamber 25 of drum 26. A plurality of lifters or baffles 27 are provided within chamber 25 of drum 26 to lift articles therein and then allow such articles to tumble back to a bottom of drum 26 as drum 26 rotates. Baffles 27 may be mounted to drum 26 such that baffles 27 rotate with drum 26 during operation of dryer appliance 11.

The rear wall 34 of drum 26 may be rotatably supported within the cabinet 12 by a suitable fixed bearing. Rear wall 34 can be fixed or can be rotatable. Rear wall 34 may include, for instance, a plurality of holes that receive hot air that has been heated by heating system 40. The heating system 40 may include, e.g., a heat pump, an electric heating element, and/or a gas heating element (e.g., gas burner). Moisture laden, heated air is drawn from drum 26 by an air handler, such as blower fan 48, which generates a negative air pressure within drum 26. The moisture laden heated air passes through a duct 44 enclosing screen filter 46, which traps lint particles. As the air passes from blower fan 48, it enters a duct 50 and then is passed into heating system 40. In some embodiments, the dryer appliance 11 may be a conventional dryer appliance, e.g., the heating system 40 may be or include an electric heating element, e.g., a resistive heating element, or a gas-powered heating element, e.g., a gas burner. In other embodiments, the dryer appliance may be a condensation dryer, such as a heat pump dryer. In such embodiments, heating system 40 may be or include a heat pump including a sealed refrigerant circuit. Heated air (with a lower moisture content than was received from drum 26), exits heating system 40 and returns to drum 26 by duct 41. After the clothing articles have been dried, they are removed from the drum 26 via opening 32. A door (FIG. 1) provides for closing or accessing drum 26 through opening 32.

In some embodiments, one or more selector inputs 102, such as knobs, buttons, touchscreen interfaces, etc., may be provided or mounted on the cabinet 12 (e.g., on a backsplash 71) and are in operable communication (e.g., electrically coupled or coupled through a wireless network band) with the processing device or controller 210. Controller 210 may also be provided in operable communication with components of the dryer appliance 11 including motor 31, blower 48, or heating system 40. In turn, signals generated in controller 210 direct operation of motor 31, blower 48, or heating system 40 in response to the position of inputs 102. As used herein, "processing device" or "controller" may refer to one or more microprocessors, microcontroller, ASICS, or semiconductor devices and is not restricted necessarily to a single element. The controller 210 may be programmed to operate dryer appliance 11 by executing instructions stored in memory (e.g., non-transitory media). The controller 56 may include, or be associated with, one or more memory elements such as RAM, ROM, or electrically erasable, programmable read only memory (EEPROM). For example, the instructions may be software or any set of instructions that when executed by the processing device, cause the processing device to perform operations. It should be noted that controllers as disclosed herein are capable of and may be operable to perform any methods and associated method steps as disclosed herein. For example, in some embodiments, methods disclosed herein may be embodied in programming instructions stored in the memory and executed by the controller 210.

Figure 4:
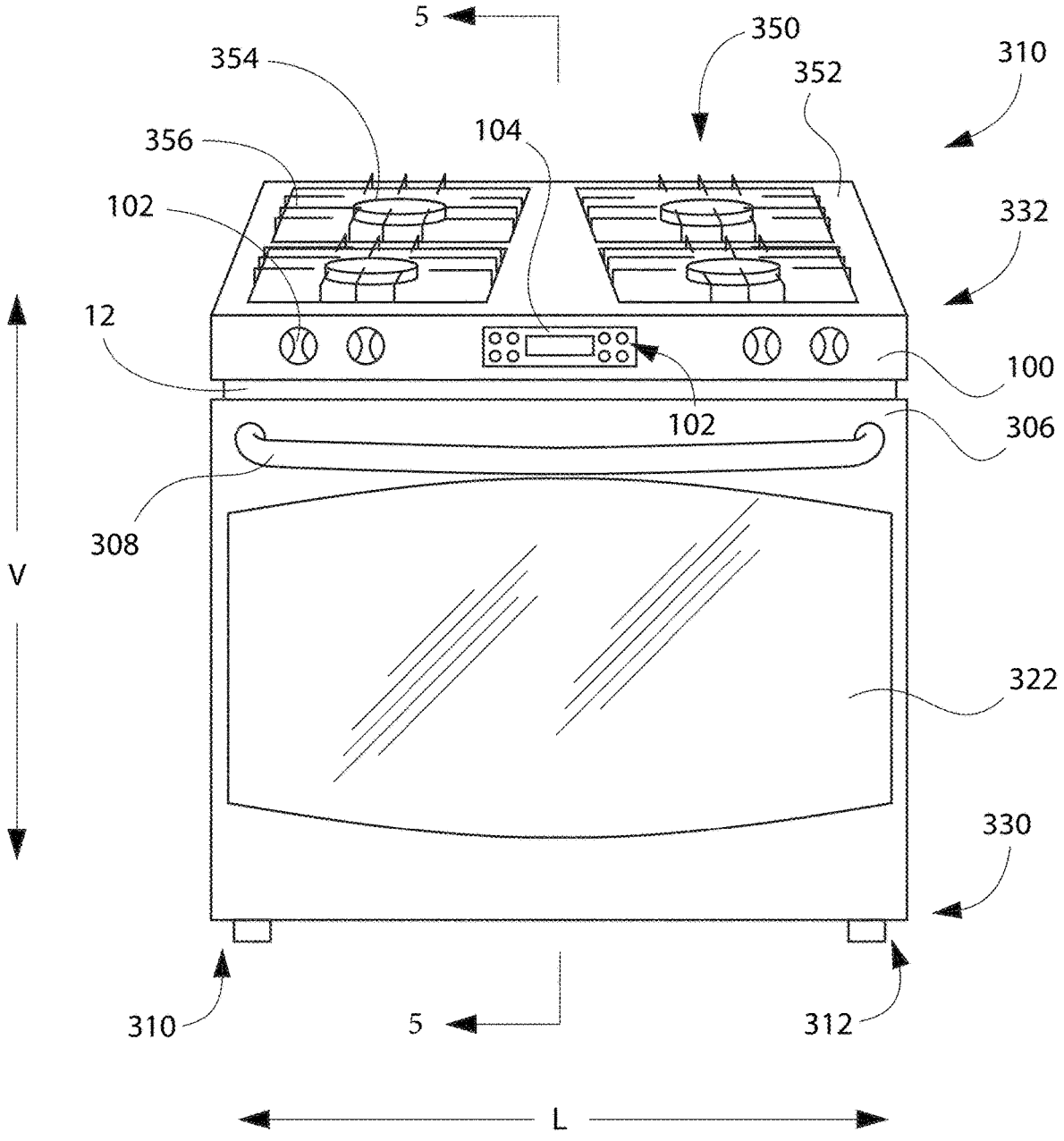
FIG. 4 provides a perspective view of an exemplary appliance, e.g., an exemplary oven appliance, according to one or more additional exemplary embodiments of the present subject matter.
Figure 5:
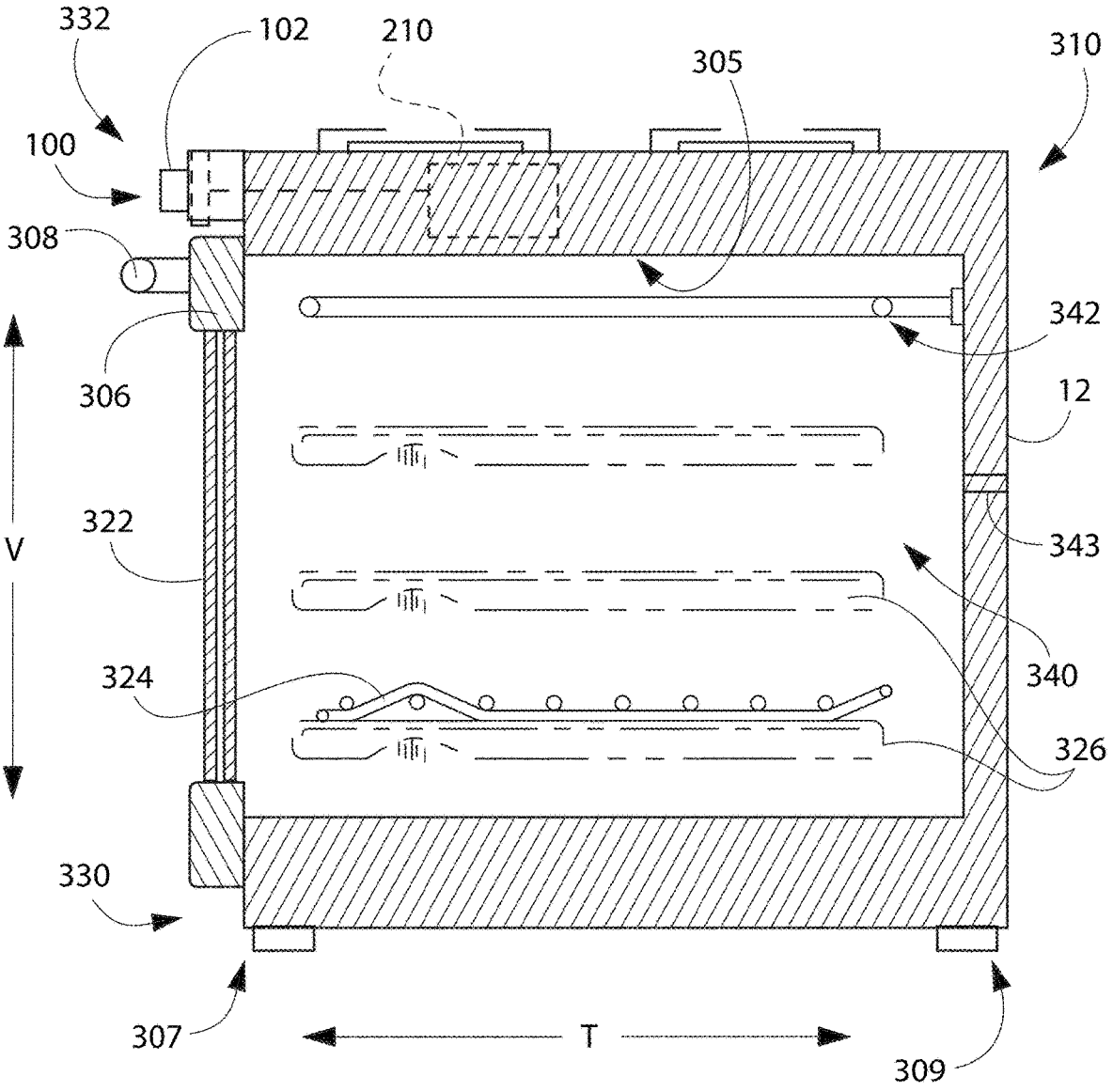
FIG. 5 provides a section view of the oven appliance of FIG. 4 taken along line 5-5 of FIG. 4.

In another example embodiment, the appliance may be a cooking appliance, such as an oven appliance 310, e.g., as illustrated in FIGS. 4 and 5.

FIG. 4 provides a front perspective view of an oven appliance 310 according to exemplary embodiments of the present subject matter. FIG. 5 provides a section view of exemplary oven appliance 310 taken along line 5-5 of FIG. 4. Oven appliance 310 is shown in FIGS. 4 and 5 as a free-standing range oven appliance, but it will be appreciated that oven appliance 310 is provided by way of example only and is not intended to limit the present subject matter in any aspect. Other cooking appliances having different configurations, different appearances, and/or different features may also be utilized with the present subject matter as well. Thus, the present subject matter may be used with other oven appliance configurations, e.g., wall ovens and/or oven appliances that define one or more interior cavities for the receipt of food items and/or having different pan or rack arrangements than what is shown in FIG. 5, as well as with cooktop-only appliances.

Oven appliance 310 includes an insulated cabinet 12 with an interior cooking chamber 340 defined by an interior surface 305 of cabinet 12. Cooking chamber 340 is configured for receipt of one or more food items to be cooked. Cabinet 12 extends between a bottom portion 330 and a top portion 332 along a vertical direction V. Cabinet 12 also extends between a front portion 307 and a back portion 309 along a transverse direction T and between a first side 311 and a second side 312 along a lateral direction L. Vertical direction V, lateral direction L, and transverse direction T are mutually perpendicular and form an orthogonal direction system.

Figure 6:
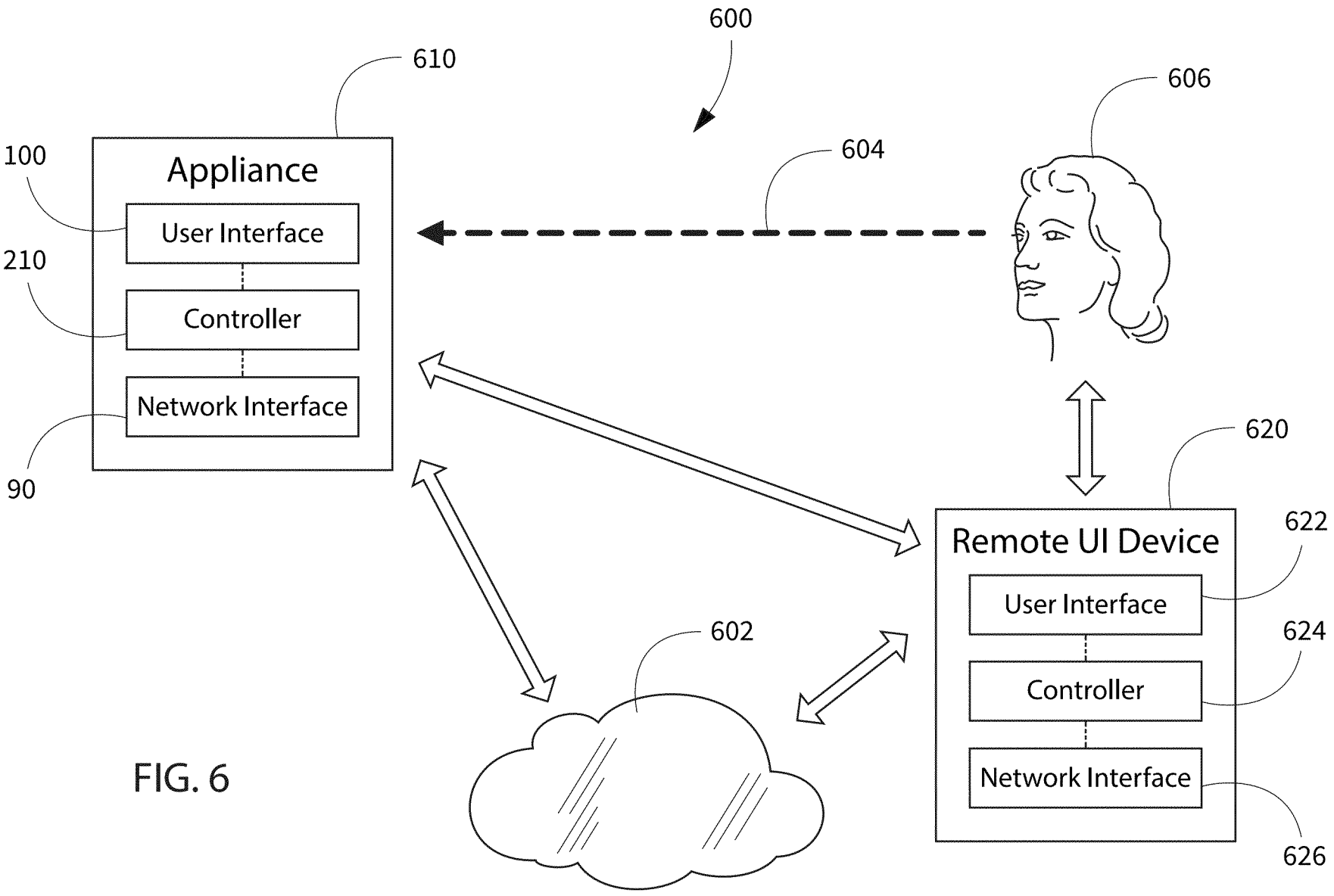
FIG. 6 provides a schematic view of a system for enabling remote operation of an appliance according to exemplary embodiments of the present subject matter.
Figure 7:
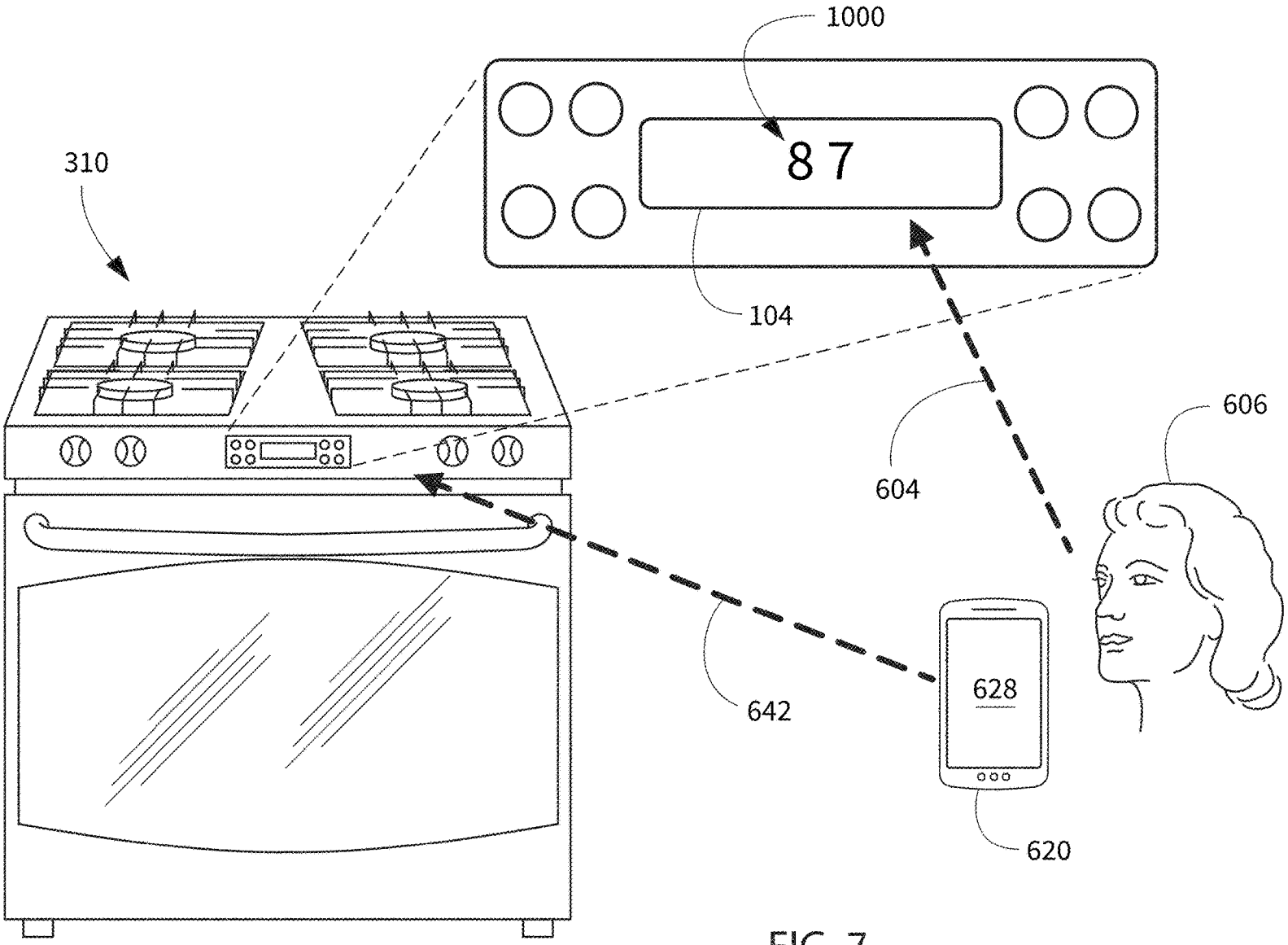
FIG. 7 provides a schematic view of a user establishing attended operation of an exemplary appliance according to exemplary embodiments of the present subject matter.

Oven appliance 310 includes a door 306 rotatably mounted to cabinet 12, e.g., with a hinge (not shown). A handle 308 is mounted to door 306 and assists a user with opening and closing door 306. For example, a user can pull or push handle 308 to open or close door 306 to access cooking chamber 340. Oven appliance 310 includes a seal (not shown) between door 306 and cabinet 12 that maintains heat and cooking fumes within cooking chamber 340 when door 306 is closed as shown in FIGS. 6 and 7. Multiple parallel glass panes 322 provide for viewing the contents of cooking chamber 340 when door 306 is closed and provide insulation for cooking chamber 340. A baking rack 324 is positioned in cooking chamber 340 for receipt of food items or utensils containing food items. Baking rack 324 is slidably received onto embossed ribs or sliding rails 326 such that rack 324 may be conveniently moved into and out of cooking chamber 340 when door 306 is open.

A top heating element or broil element 342 is positioned in cooking chamber 340 of cabinet 12 proximate top portion 332 of cabinet 12. Top heating element 342 is used to heat cooking chamber 340 for both cooking/broiling and cleaning of oven appliance 310. The size and heat output of top heating element 342 can be selected based on, e.g., the size of oven appliance 310. In the exemplary embodiment shown in FIG. 5, top heating element 342 is shown as an electric resistance heating element. In additional embodiments, the top heating element 342 may be any suitable heating element, e.g., a magnetron, a gas burner, a heat lamp, and combinations of one or more of such heating elements of the same or varied types. In some embodiments, oven appliance 310 may include one or more heating elements in addition to or other than the top heating element, such as a bottom heating element, which may include an electric resistance heating element, an induction heating element, a magnetron, a gas burner, a heat lamp, and combinations of one or more of such heating elements of the same or varied types.

As shown in FIG. 4, oven appliance 310 includes a cooktop 350. Cooktop 350 is disposed on and is attached to or integral with cabinet 12. Cooktop 350 includes a top panel 352, which by way of example may be constructed of glass, ceramics, enameled steel, or combinations thereof. One or more burners 354 extend through top panel 352. A utensil (e.g., pots, pans, etc.) holding food and/or cooking liquids (e.g., oil, water, etc.) may be placed onto grates 356 disposed adjacent burners 354. Burners 354 provide thermal energy to cooking utensils placed on grates 356. Burners 354 can be any suitable type of burners, including e.g., gas, electric, electromagnetic, a combination of the foregoing, etc. It will be appreciated that the configuration of cooktop 350 is provided by way of example only and that other suitable configurations are contemplated.

Oven appliance 310 includes a user interface panel 100. For this exemplary embodiment, the user input devices 102 of the user interface panel 100 include a number of knobs 102 (e.g., knobs are an embodiment of a user input device 102) that each correspond to one of the burners 354. Knobs 102 allow users to activate each burner 354 and to determine the amount of heat input provided by each burner 354 to a cooking utensil located thereon.

User interface panel 100 also includes a display component 104 that provides visual information to a user and may also allow the user to select various operational features for the operation of oven appliance 310, e.g., the display component 104 may be a touchscreen which is configured to receive user input by a touch on the screen. In some embodiments, the oven appliance 310 may include one or more touchpad buttons 102 (which are another exemplary embodiment of user input devices 102), as well as or instead of the display component 104, e.g., when the display component 104 is not provided or is not a touchscreen. One or more of a variety of electrical, mechanical or electromechanical input devices including rotary dials, push buttons, toggle/rocker switches, and/or touch pads can also be used singularly or in combination as user input devices 102.

The display component 104 on user interface panel 100 may present certain information to users, such as, e.g., whether a particular burner 354 is activated and/or the level at which the burner 354 is set. Display 104 can be a touch sensitive component (e.g., a touch-sensitive display screen) that is sensitive to the touch of a user input object (e.g., a finger or a stylus). Display 104 may include one or more graphical user interfaces that allow for a user to select or manipulate various operational features of oven appliance 310 or its cooktop 350.

Referring now specifically to FIG. 5, the operation of oven appliance 310 is controlled by a processing device or controller 210. As shown, controller 210 is communicatively coupled with user interface panel 100 and its user input devices 102. Controller 210 may also be communicatively coupled with various operational components of oven appliance 310 as well, such as a heating assembly, e.g., heating element 342 and/or other similar heating elements which may be provided, as discussed above, temperature sensors, cameras, speakers, and microphones, etc. Input/output ("I/O") signals may be routed between controller 210 and the various operational components of oven appliance 310. Thus, controller 210 can selectively activate and operate these various components. Various components of oven appliance 310 are communicatively coupled with controller 210 via one or more communication lines (e.g., represented by dashed lines in FIG. 7), such as, e.g., signal lines, shared communication busses, or wirelessly. Controller 210 can be positioned in a variety of locations throughout oven appliance 310. For this embodiment, controller 210 is located proximate user interface panel 100 toward top portion 332 of oven appliance 310.

The oven appliance 310 may further include one or more temperature sensors, such as to measure temperature in or around the oven appliance 310, e.g., a temperature in the cooking chamber 340 or at the cooktop 350. For example, oven appliance 310 may include a temperature sensor 343 (FIG. 5). As used herein, "temperature sensor" or the equivalent is intended to refer to any suitable type of temperature measuring system or device positioned at any suitable location for measuring the desired temperature. The temperature sensor(s) of the oven appliance 310 may be, for example, thermistors or any other suitable type of temperature sensor, such as a thermistor, a thermocouple, a resistance temperature detector, a semiconductor-based integrated circuit temperature sensors, etc. In addition, temperature sensor(s) 343 may be positioned at any suitable location and may output a signal, such as a voltage, to a controller that is proportional to and/or indicative of the temperature being measured. Although exemplary positioning of temperature sensors is described herein, it should be appreciated that oven appliance 310 may include any other suitable number, type, and position of temperature, humidity, and/or other sensors according to alternative embodiments.

As noted above, the configuration of oven appliance 310 illustrated in FIGS. 4 and 5 is by way of example only, and aspects of the present disclosure may also be used with other cooking appliances, such as cooktop appliances, wall ovens, or various other oven appliances having different heating elements, such as gas burners on the cooktop and/or one or more gas heating elements in the cooking chamber, or other heating elements, as well as variations in the number or size of burners, or variations in the location, position, or type of controls on the user interface, among numerous other possible variations in the configuration of the oven appliance 310 within the scope of the present disclosure.

Turning now to FIG. 6, a general schematic is provided of a system 600 for contactless remote activation of an appliance 610 (such as washing machine appliance 10, dryer appliance 11, oven appliance 310, or other suitable appliance) according to exemplary embodiments of the present subject matter. As shown, appliance 610 communicates wirelessly with a remote user interface device 620 and a network 602. For example, as illustrated in FIG. 6, the appliance 610 may include a network interface 90 by which the appliance 610 communicates with, e.g., sends and receives signals to and from, the remote user interface device 620 and/or network 602. The network interface 90 may include for example, an antenna for sending and receiving wireless signals. The network interface 90 may be a wireless communications module operable to connect wirelessly, e.g., over the air, to one or more other devices via any suitable wireless communication protocol. For example, the network interface 90 may be a WI-FI® module, a BLUETOOTH® module, or a combination module providing both WI-FI® and BLUETOOTH® connectivity. The remote user interface device 620 may be a laptop computer, smartphone, tablet, personal computer, wearable device, smart speaker, smart home system, and/or various other suitable devices. The network interface 90 may be onboard the controller 210 or may be a separate module.

The appliance 610 may be in communication with the remote user interface device 620 through various possible communication connections and interfaces. The appliance 610 and the remote user interface device 620 may be matched in wireless communication, e.g., connected to the same wireless network. The appliance 610 may communicate with the remote user interface device 620 via short-range radio such as BLUETOOTH® or any other suitable wireless network having a layer protocol architecture. As used herein, "short-range" may include ranges less than about ten meters and up to about one hundred meters. For example, the wireless network may be adapted for short-wavelength ultra-high frequency (UHF) communications in a band between 2.4 GHz and 2.485 GHz (e.g., according to the IEEE 802.15.1 standard). In particular, BLUETOOTH® Low Energy, e.g., BLUETOOTH® Version 4.0 or higher, may advantageously provide short-range wireless communication between the appliance 610 and the remote user interface device 620. For example, BLUETOOTH® Low Energy may advantageously minimize the power consumed by the exemplary methods and devices described herein due to the low power networking protocol of BLUETOOTH® Low Energy.

The remote user interface device 620 is "remote" at least in that it is spaced apart from and not physically connected to the appliance 610, e.g., the remote user interface device 620 is a separate, stand-alone device from the appliance 610 which communicates with the appliance 610 wirelessly. Any suitable device separate from the appliance 610 that is configured to provide and/or receive communications, information, data, or commands from a user may serve as the remote user interface device 620, such as a smartphone (e.g., as illustrated in FIG. 7), smart watch, personal computer, smart home system, or other similar device. For example, the remote user interface device 620 may be a smartphone operable to store and run applications, also known as "apps," and some or all of the method steps disclosed herein may be performed by a smartphone app.

The remote user interface device 620 may include a memory for storing and retrieving programming instructions. Thus, the remote user interface device 620 may provide a remote user interface which may be an additional user interface to the user interface panel 100. For example, the remote user interface device 620 may be a smartphone operable to store and run applications, also known as "apps," and the additional user interface may be provided as a smartphone app.

The remote user interface device 620 may include one or more user device controllers 624. Controller 624 can include one or more processors and one or more memory devices. The one or more processors can be any suitable processing device (e.g., a processor core, a microprocessor, an ASIC, a FPGA, a controller, a microcontroller, etc.) and can be one processor or a plurality of processors that are operatively connected. The memory device can include one or more non-transitory computer-readable storage mediums, such as RAM, ROM, EEPROM, EPROM, flash memory devices, magnetic disks, etc., and combinations thereof. The memory can store data and instructions which are executed by the processor to cause remote user interface device 620 to perform operations. Controller 624 includes a remote user interface device network interface 626 such that remote user interface device 620 may connect to and communicate over one or more networks. Network interface 626 can be an onboard component of controller 624 or it can be a separate, off board component. Controller 624 can also include one or more transmitting, receiving, and/or transceiving components for transmitting/receiving communications with other devices communicatively coupled with remote user interface device 620. Additionally or alternatively, one or more transmitting, receiving, and/or transceiving components can be located off board controller 624.

As mentioned above, the appliance 610 may also be configured to communicate wirelessly with a network 202. The network 202 may be, e.g., a cloud-based data storage system including one or more remote computing devices such as remote databases and/or remote servers, which may be collectively referred to as "the cloud." For example, the appliance 610 may communicate with the cloud 202 over the Internet, which the appliance 610 may access via WI-FI®, such as from a WI-FI® access point in a user's home, in a dormitory or apartment building, or in a laundromat, etc.

The remote user interface device 620 is communicatively coupled with network 602 such that remote user interface device 620 can communicate with appliance 610. The remote user interface device 620 may communicate with appliance 610 via network 602. The remote user interface device 620 may communicate directly with appliance 610 as well as or instead of via the network 602. Moreover, user 606 may be in operative communication with remote user interface device 620 such that user 606 may communicate with appliance 610 via remote user interface device 620. The user 606 may be in visual communication 604 with one or more displays of appliance 610 (e.g., display 104) and/or a display 628 (FIG. 7) of the remote user interface device 620 as well.

The remote user interface device 620 may include one or more user inputs such as e.g., buttons, one or more cameras, and/or display 628 configured to display graphical user interfaces and/or other visual representations to user 606. For example, the display 628 of the remote user interface device 620 may display graphical user interfaces corresponding to operational features of appliance 610 such that user 606 may manipulate or select the features to operate the appliance 610. The display 628 can be a touch sensitive component (e.g., a touch-sensitive display screen or a touch pad) that is sensitive to the touch of a user input object (e.g., a finger or a stylus). For example, a user may touch the display 628 with his or her finger and type in a series of numbers on the display 628. In addition, motion of the user input object relative to the display 628 can enable user 606 to provide input to remote user interface device 620. The remote user interface device 620 may also provide other suitable methods for providing input thereto. Moreover, remote user interface device 620 can include one or more speakers, one or more cameras, and/or more than one microphones such that remote user interface device 620 is configured with voice control, motion detection, and other functionality. Collectively, these input and communication devices make up a user interface 622 of the remote user interface device 620. As shown, user interface 622 is communicatively coupled with the controller 624 of the remote user interface device 620.

User 606 may wish to operate appliance 610 remotely. In particular, user 606 may wish to operate operational features of appliance 610 that require attended operation. Examples of operational features that may require attended operation include turning on oven appliance 310, turning on cooktop 350, selecting a temperature setting for oven appliance 310 or cooktop 350, or choosing a mode of operation of oven appliance 310. Additional examples of operational features that may require attended operation include initiating a cycle of the washing machine appliance 10 or dryer appliance 11, locking a door of the washing machine appliance 10 or dryer appliance 11, or selecting a heat setting for the dryer appliance 11. Because certain operational features may require attended operation, appliance 610 may require user 606 to prove attended operation. To prove attended operation, oven appliance 610 (or a device or system communicatively coupled with appliance 610) may seek to establish that user 606 is in an attended operation before enabling remote operational functionality. To establish attended operation of appliance 610, user 606 may communicate with appliance 610 indirectly via remote user interface device 620 and/or network 602, e.g., without physically contacting, e.g., touching, the appliance 610.

FIG. 7 provides a schematic view of user 606 establishing attended operation of an appliance, which may be any appliance as disclosed herein, and which is illustrated as oven appliance 310 for example in FIG. 7. For this embodiment, user 606 sends a request 642 to remotely operate oven appliance 310 via remote user interface device 620. For example, user 606 might enter a control input such as a text command to remote user interface device 620 such as e.g., one or more settings (operational parameters) for an operation cycle of the appliance, e.g., a time for a dryer cycle, a spin speed for a washing machine cycle, or a time and/or heat level, e.g., temperature, for a cooking cycle of the illustrated exemplary oven appliance 310. The remote user interface device 620 forwards request 642 to oven appliance 310. Oven appliance 310 receives request 642, and recognizing that proof of attended operation is required for the particular request, controller 210 of oven appliance 310 determines that attended operation must be confirmed or authenticated before remote functionality is enabled, e.g., before initiating the selected cycle.

To confirm attended operation, an authentication code or access code may be generated and displayed, at least partially, on the display 104 of the appliance, e.g., oven appliance 310 (as illustrated in FIGS. 6 and 7) or any other suitable appliance. The access code may be generated in the cloud, e.g., by one or more remote computing devices. As mentioned, the user 606 may be in visual communication 604 with the appliance, including the display 104 thereof. Accordingly, the appliance, e.g., oven appliance 310, may present the access code, or a portion thereof, to user 606 via user interface 100, such as e.g., an alphanumeric series of letters and/or numbers presented on display 104. When viewing (via visual communication 604) the user interface 100 of the appliance, user 606 also views the appliance and its surroundings. In this way, it is ensured that user 606 has had an opportunity to check for potentially dangerous conditions in and around the appliance before activating the appliance remotely. Thus, attended operation may be verified by the user 606 being within visual range of the appliance and/or display 104 such that the user 606 can read the first portion 1000 of the access code from the display 104 and provide a verification input based on the access code via the user interface 622 of the remote user interface device 620, e.g., without touching the appliance itself, such as without having to press a start button or other input on the appliance.

In some embodiments, the access code may be or may include a mathematical formula, and the verification input based on the mathematical formula may be the result of the formula or solution to the formula. For example, a first portion 1000 of the access code may be displayed on the display 104 of the appliance, e.g., oven appliance 310, and a second portion of the access code may be displayed on the display 628 of the remote user interface device 620. In embodiments where the access code is a mathematical formula, the first portion 1000 of the access code may be a set of numbers, e.g., single-digit numbers, such as two numbers, such as two single-digit numbers. As illustrated in FIG. 7 for example, the first portion 1000 of the access code comprises the two single-digit numbers 8 and 7. A second portion of the access code may be displayed on the display 628 of the remote user interface device 620, such as the second portion may include a mathematical operation, e.g., addition, subtraction, multiplication, or division. For example, a prompt including the mathematical operation may be displayed on the display 628 of the remote user interface device 620, e.g., "Can you add the two numbers on the machine?" In response, the user 606 may enter the solution to the mathematical operation, e.g., 15 (which is the solution to the mathematical formula 7+8) in the illustrated example, via the user interface 622 of the remote user interface device 620, i.e., in this example the verification input may be the number 15, which is the solution to the mathematical formula derived from the numbers displayed on the display 104 of the appliance and the operation displayed on the display 628 of the remote user interface device 620.

Any suitable display of the appliance may be used to display the first portion 1000 of the access code. For example, the display may be a relatively simple display, such as a seven-segment display, e.g., the appliance may not include a context-sensitive display or touchscreen display.

Exemplary methods for operating an appliance, such as a laundry appliance or cooking appliance as described above, are provided. In this regard, for example, a controller of the appliance, e.g., controller 210, may be configured for implementing some or all steps of one or more of the following exemplary methods. Additionally, some aspects of the exemplary methods disclosed herein may be performed locally, e.g., on controller 210 or a dedicated controller integrated into the appliance, while other aspects (or all aspects) may be performed remotely. However, it should be appreciated that the exemplary methods are discussed herein only to describe exemplary aspects of the present subject matter, and are not intended to be limiting.

Now that the construction of exemplary appliances and the configuration of controller 210 according to exemplary embodiments have been presented, exemplary methods of operating an appliance will be described. In exemplary embodiments, the various method steps as disclosed herein may be performed by controller 210 or a separate, dedicated controller. Furthermore, some or all of the various method steps may be performed remotely, e.g., in a distributed computing environment such as the cloud, fog, or edge, wherein the controller 210 communicates with one or more remote computing devices of the distributed computing environment, such as processing, e.g., image analysis and/or processing, may be performed in the cloud and the output of such process may be transmitted to and received by the appliance, such as by the controller 210 thereof via the network interface 90.

Figure 8:
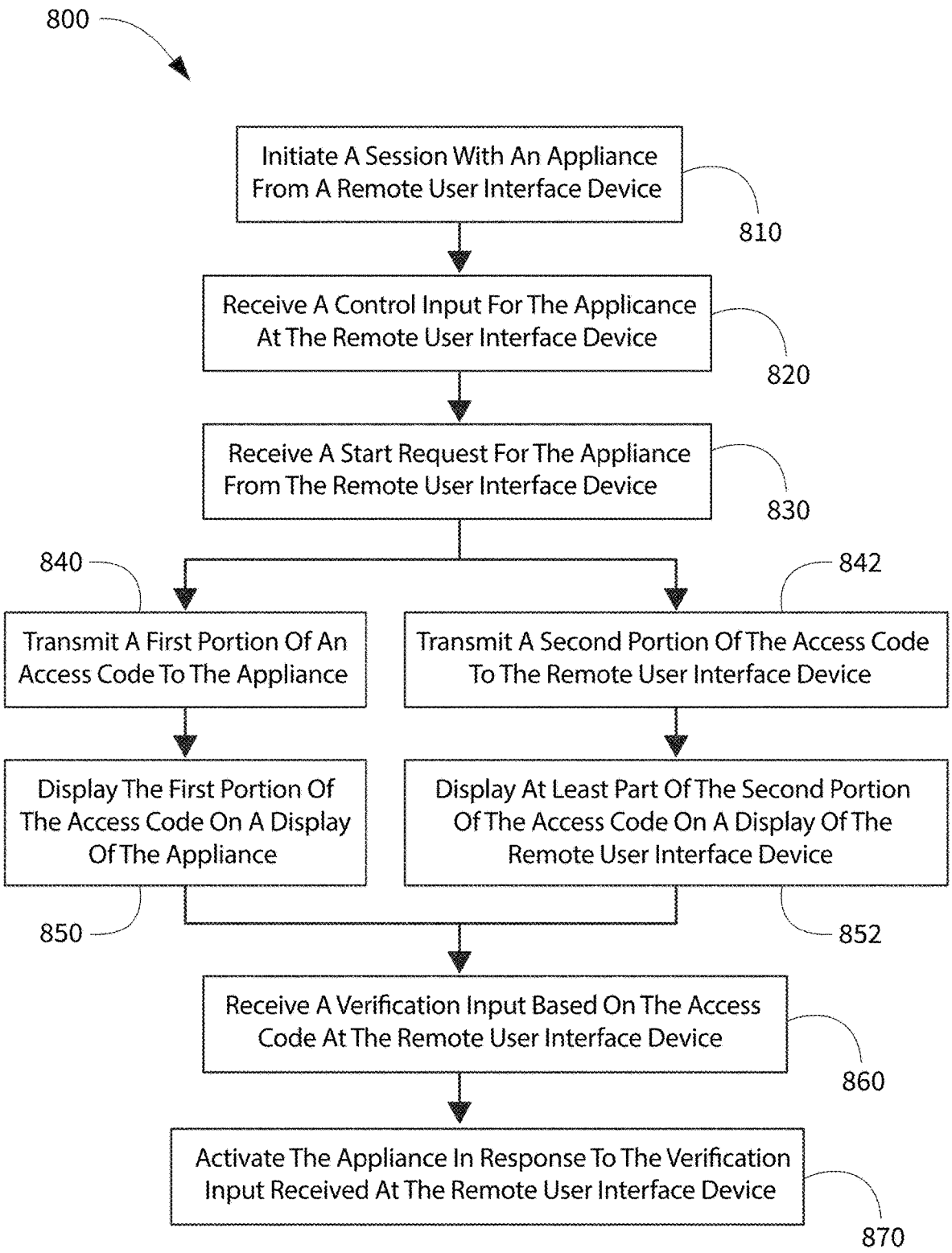
FIG. 8 provides a flow diagram of an exemplary method for operating an appliance according to one or more exemplary embodiments of the present subject matter.

FIG. 8 depicts steps performed in a particular order for purposes of illustration and discussion. Those of ordinary skill in the art, using the disclosures provided herein, will understand that (except as otherwise indicated) method 800 can be modified, adapted, rearranged, omitted, interchanged, or expanded in various ways without deviating from the scope of the present disclosure.

An exemplary method 800 of operating an appliance is illustrated in FIG. 8. As shown in FIG. 8, method 800 may include (810) initiating a session with the appliance from a remote user interface device. For example, the user may create a session with the appliance by inputting an identifier of the appliance into an app on the remote user interface device. The identifier of the appliance may be, for example, a Media Access Control (MAC) address, or other unique identifier for that particular machine. In some embodiments, the identifier may be embedded in a bar code, such as a one-dimensional bar code or a QR code, on the machine, and the user may scan such code, e.g., with a camera of the remote user interface device.

Method 800 may further include (820) receiving a control input for the appliance at the remote user interface device. The control input may include one or more user selections, such as selected settings and/or operating parameters, for an operation cycle of the appliance. For example, the control input may be or may include a selected wash program and water temperature, e.g., in embodiments where the appliance is a washing machine appliance.

Method 800 may further include (830) receiving a start request for the appliance from the remote user interface device. For example, after the user has finished entering selections for the cycle, the user may select a continue or start function, such as pressing a continue button on the remote user interface (which may be, e.g., a software button and/or interactive icon on a touchscreen display).

In response to the control input and/or the start request, a remote computing device, e.g., in the cloud as mentioned above, may generate and transmit an access code in order to permit contactless verification of the user for remote activation of the appliance. For example, the contactless verification may include activating the appliance in response to a verification input received at the remote user interface device, without a direct physical input at a local user interface of the appliance, such as without requiring the user to verify attended operation of the appliance by directly touching a button or other physical input of the appliance. Thus, method 800 may also include (840) transmitting a first portion of an access code to the appliance from a remote computing device and (842) transmitting a second portion of the access code to the remote user interface device. The first and second portions of the access code may be distinct or may overlap. For example, where the access code is a mathematical formula, the first portion of the mathematical formula which is transmitted to the appliance may include only the numbers in the mathematical formula. In such embodiments, the second portion of the mathematical formula which is transmitted to the remote user interface device may include only the operation, or may include the numbers and the operation.

Method 800 may further include (850) displaying the first portion of the access code on a display of the appliance and (852) displaying at least part of the second portion of the access code on a display of the remote user interface device. For example, where the access code comprises a mathematical formula, the second portion which is transmitted to the remote user interface device may include only the operation, and the entire second portion may be displayed on the remote user interface device. As another example, where the access code comprises a mathematical formula, the second portion which is transmitted to the remote user interface device may include the operation and the numbers, and only a part of the second portion may be displayed on the remote user interface device, e.g., only the operation may be displayed such that the user still has to look at (e.g., be in visual communication with) the appliance to determine the other portion, e.g., the numbers, of the access code.

Method 800 may also include (860) receiving a verification input at the remote user interface device, and the verification input may be based on the access code. For example, when the access code is a mathematical formula, the verification input based on the access code may be the solution to the mathematical formula. In another example, the access code may be an alphanumeric code, the first portion may be the numeric portion that is displayed on the appliance, and the second portion may be the alphabetic portion. In such embodiments, the verification input may include the entire alphanumeric access code, with the first and second portions combined according to instructions provided via the user interface of the remote user interface device to arrive at the verification input.

In response to the verification input received at the remote user interface device, method 800 may include (870) activating the appliance, and activating the appliance may include initiating an operation cycle of the appliance, e.g., according to the control input, such as initiating the operation cycle with the selected water temperature in a washing machine appliance, among other possible examples. In some embodiments, the verification input may be transmitted from the remote user interface device to the cloud, e.g., to one or more remote computing devices. Such embodiments may further include receiving, by the remote computing device, the verification input from the remote user interface device and validating the verification input by the remote computing device before activating the appliance.

Activating the appliance, e.g., in (870) of method 800, includes causing at least one mechanical component of the appliance to be operated. For example, the mechanical component may be a motor, such as the motor 122 of the washing machine appliance or the motor 31 of the dryer appliance, a fan, a heating element such as heating element 342 (FIG. 5) or a heating element of heating system 40 (FIG. 3), a pump, a compressor, or a valve, among other possible example mechanical components of an appliance. Also, operating the mechanical component includes changing a physical status of the component, e.g., a speed, position, etc. of the component, such as accelerating the motor, fan, etc., e.g., from a zero starting speed, opening a valve, and/or other changes in the physical state of one or more mechanical components of the appliance. Thus it is to be understood that the appliance may also include a mechanical component, and methods according to the present disclosure may further include activating the mechanical component. For example, the mechanical component may be activated remotely after verifying the attended operation, e.g., via the verification input as described.

In some embodiments, methods according to the present subject matter, such as method 800, may include activating the appliance in response to the control input received at the remote user interface device without a direct physical input at a local user interface of the appliance, e.g., the operation of the appliance may be touch-free, contactless, and entirely remote.

In some exemplary methods, e.g., method 800, initiating the operation cycle of the appliance may include locking a door of the appliance. In additional exemplary embodiments, initiating the operation cycle of the appliance may also or instead include activating a heating element of the appliance.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating an appliance, the method comprising:

initiating a session with the appliance from a remote user interface device;

receiving a control input for the appliance at the remote user interface device;

transmitting a first portion of an access code to the appliance from a remote computing device in response to the control input;

transmitting a second portion of the access code to the remote user interface device from the remote computing device in response to the control input;

displaying the first portion of the access code on a display of the appliance;

displaying at least part of the second portion of the access code on a display of the remote user interface device;

receiving a verification input at the remote user interface device, the verification input based on the access code; and activating the appliance in response to the verification input received at the remote user interface device, wherein activating the appliance comprises initiating an operation cycle of the appliance according to the control input.

2. The method of claim 1, wherein the access code comprises a mathematical formula, and the verification input comprises the solution to the mathematical formula.

3. The method of claim 2, wherein the first portion of the access code comprises two single-digit numbers, and wherein displaying at least part of the second portion of the access code on the display of the remote user interface device comprises displaying a mathematical operation on the display of the remote user interface device.

4. The method of claim 1, further comprising receiving, by the remote computing device, the verification input from the remote user interface device and validating the verification input by the remote computing device before activating the appliance.

5. The method of claim 1, wherein the appliance is activated in response to the verification input received at the remote user interface device without a direct physical input at a local user interface of the appliance.

6. The method of claim 1, wherein initiating the operation cycle of the appliance comprises locking a door of the appliance.

7. The method of claim 1, wherein initiating the operation cycle of the appliance comprises activating a heating element of the appliance.

8. The method of claim 1, wherein the appliance is a laundry appliance.

9. The method of claim 1, wherein the appliance is a cooking appliance.

10. A method of operating an appliance, the method comprising:

receiving a start request for the appliance from a remote user interface device;

transmitting, by a remote computing device in response to the start request, a first portion of an access code to the appliance and a second portion of the access code to the remote user interface device;

displaying the first portion of the access code on a display of the appliance;

displaying at least part of the second portion of the access code on a display of the remote user interface device;

receiving a verification input at the remote user interface device, the verification input based on the access code; and activating the appliance in response to the verification input received at the remote user interface device, wherein activating the appliance comprises initiating an operation cycle of the appliance.

11. The method of claim 10, wherein the access code comprises a mathematical formula, and the verification input comprises the solution to the mathematical formula.

12. The method of claim 11, wherein the first portion of the access code comprises two single-digit numbers, and wherein displaying at least part of the second portion of the access code on the display of the remote user interface device comprises displaying a mathematical operation on the display of the remote user interface device.

13. The method of claim 10, further comprising receiving, by the remote computing device, the verification input from the remote user interface device and validating the verification input by the remote computing device before activating the appliance.

14. The method of claim 10, wherein the appliance is activated in response to the verification input received at the remote user interface device without a direct physical input at a local user interface of the appliance.

15. The method of claim 10, wherein initiating the operation cycle of the appliance comprises locking a door of the appliance.

16. The method of claim 10, wherein initiating the operation cycle of the appliance comprises activating a heating element of the appliance.

17. The method of claim 10, wherein the appliance is a laundry appliance.

18. The method of claim 10, wherein the appliance is a cooking appliance.

* * * * *